US008937827B2

(12) United States Patent
Macerini et al.

(10) Patent No.: US 8,937,827 B2
(45) Date of Patent: Jan. 20, 2015

(54) METHOD AND SYSTEM FOR EXTRACTING ELECTRIC POWER FROM A RENEWABLE POWER SOURCE

(75) Inventors: Sauro Macerini, Levane (IT); David Martini, Valdarno (IT); Silvio Scaletti, Val di Chiana (IT)

(73) Assignee: Power-One Italy S.p.A., Arezzo (IT)

( * ) Notice: Subject to any disclaimer, the term of this patent is extended or adjusted under 35 U.S.C. 154(b) by 738 days.

(21) Appl. No.: 13/143,627

(22) PCT Filed: Jan. 7, 2009

(86) PCT No.: PCT/IT2009/000002

§ 371 (c)(1),
(2), (4) Date: Jul. 7, 2011

(87) PCT Pub. No.: WO2010/079517

PCT Pub. Date: Jul. 15, 2010

(65) Prior Publication Data

US 2011/0276195 A1 Nov. 10, 2011

(51) Int. Cl.
*H02M 5/42* (2006.01)
*G05F 1/67* (2006.01)

(52) U.S. Cl.
CPC ..... *G05F 1/67* (2013.01); *Y10S 323/906* (2013.01)
USPC ..... 363/95; 323/299; 323/906

(58) Field of Classification Search
USPC ..... 323/222, 224, 237, 272, 280, 282–299, 323/906; 363/16–20, 21.4, 21.8, 21.12, 363/21.13, 21.16, 34, 37, 89, 95; 307/99, 307/52, 117
See application file for complete search history.

(56) References Cited

U.S. PATENT DOCUMENTS 4,175,249 A 11/1979 Gruber
4,200,833 A * 4/1980 Wilkerson ..... 323/283
4,341,607 A 7/1982 Tison
(Continued)

FOREIGN PATENT DOCUMENTS

EP 0895146 7/1997
JP 20000347753 6/1999
(Continued)

OTHER PUBLICATIONS

Niebauer, M., et al: "Solarenergie Optimal Nutzen Intelligentes MPP-Tracking MIT Einem ST62-Mikrocontroller" Elektronik, Aug. 6, 1996 IRL press vol. 45, Nr. 16, pp. 86-89, XP000622027.

*Primary Examiner* — Rajnikant Patel
(74) *Attorney, Agent, or Firm* — Waddey Patterson; Mark J. Patterson; Gary L. Montle

(57) ABSTRACT

The plant comprises: a DC-voltage electric power source (3), whose operating conditions vary as a function of at least one uncontrollable quantity, for each value of the uncontrollable quantity the source presenting a characteristic curve of the supplied power as a function of a controlled quantity, wherein each characteristic curve presents a maximum for an optimal value of said controlled quantity; a power conditioning circuit (5); a regulation loop (9) to adjust the controlled quantity maximizing the power supplied by the source when said uncontrollable quantity varies. The regulation loop is designed in such a way as to determine whether, for the actual value of said uncontrollable quantity, the actual value of the controlled quantity (V.in) is greater or lower than the optimal value and to generate a regulation signal (V.in-REF) to modify the actual value of the controlled quantity towards the optimal value.

16 Claims, 5 Drawing Sheets

(56) References Cited

U.S. PATENT DOCUMENTS

| | | | | | |
|---|---|---|---|---|---|
| 4,375,662 | A | * | 3/1983 | Baker | 363/95 |
| 4,404,472 | A | * | 9/1983 | Steigerwald | 307/46 |
| 4,494,180 | A | * | 1/1985 | Streater et al. | 363/37 |
| 4,580,090 | A | | 4/1986 | Bailey et al. | |
| 4,873,480 | A | | 10/1989 | Lafferty | |
| 5,293,447 | A | | 3/1994 | Fanney | |
| 5,327,071 | A | | 7/1994 | Frederick et al. | |
| 5,604,430 | A | | 2/1997 | Decker | |
| 5,719,758 | A | * | 2/1998 | Nakata et al. | 363/98 |
| 5,801,519 | A | * | 9/1998 | Midya et al. | 323/222 |
| 6,369,462 | B1 | | 4/2002 | Siri | |
| 6,946,822 | B2 | * | 9/2005 | Cincinelli et al. | 323/282 |
| 7,479,774 | B2 | * | 1/2009 | Wai et al. | 323/284 |
| 8,120,341 | B2 | * | 2/2012 | Melanson | 323/282 |
| 2006/0164065 | A1 | | 7/2006 | Hoouk | |

FOREIGN PATENT DOCUMENTS

| | | |
|---|---|---|
| JP | 200160121 | 3/2001 |
| JP | 2005115553 | 4/2005 |
| JP | 2008176474 | 7/2008 |
| WO | 2005069096 | 1/2004 |
| WO | 2007007360 | 7/2005 |
| WO | 2007072517 | 12/2005 |

* cited by examiner

P

P1
PY
P2
Pn
Px
IR
C1
C2
Cn
V
Vn
V2
V1

P

PMPP
Pmax
Pb
Pa
C
V
Vb
VmPP
Va

Fig. 5(A
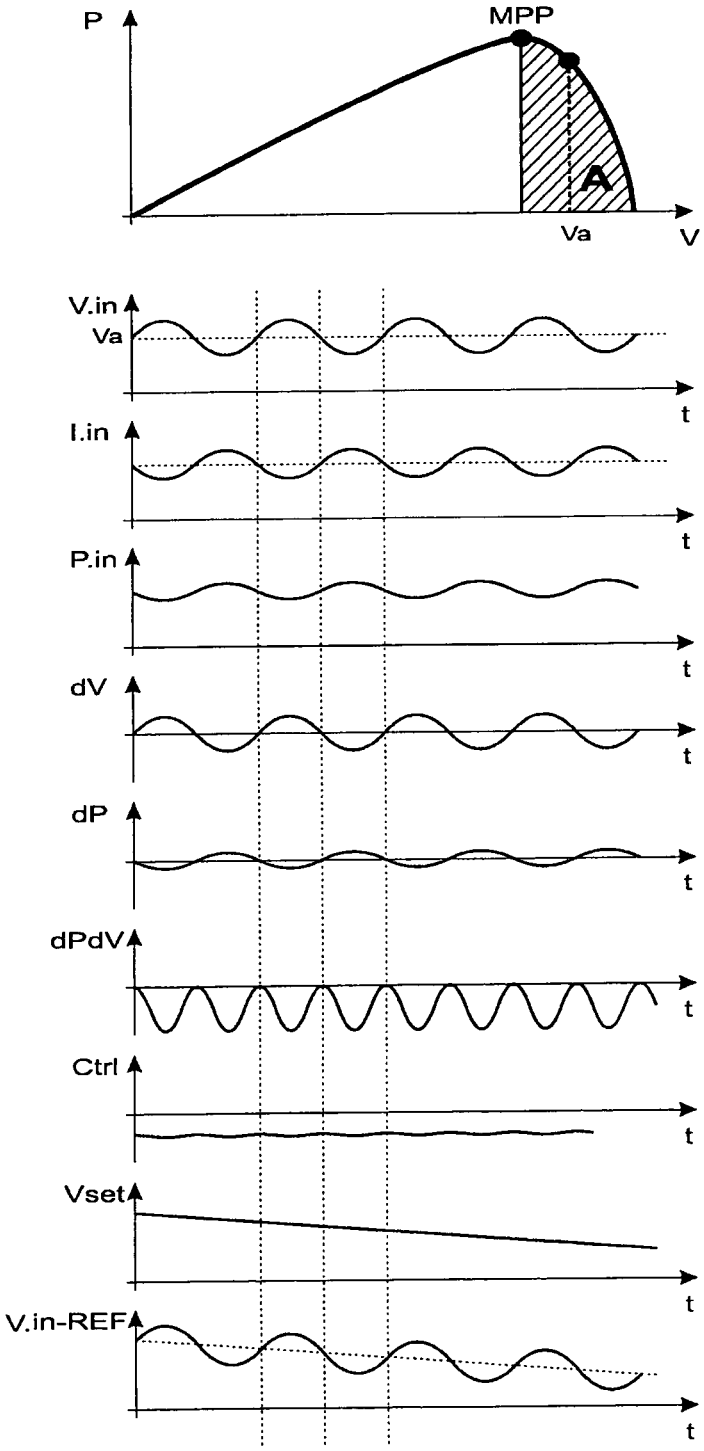

METHOD AND SYSTEM FOR EXTRACTING ELECTRIC POWER FROM A RENEWABLE POWER SOURCE

TECHNICAL FIELD

The present invention relates to the exploitation of alternative energy sources, and more in particular to the exploitation of renewable energy sources. In particular, although not exclusively, the present invention relates to improvements to the methods and the systems for the exploitation of the solar energy by means of photovoltaic panels.

More in general, the present invention relates to improvements to methods and systems for extracting power from a source, whose operative conditions vary as a function of at least one uncontrollable quantity and that has, for each value of the uncontrollable quantity, a characteristic curve of the power supplied as a function of a controlled quantity, where the characteristic curve for each value of the uncontrollable quantity has a maximum for an optimal value of the controlled quantity.

STATE OF THE ART

Due to the increasingly growing energy requirement and the problems linked to the exhaustion of the traditional energy sources, as well as following the environmental impact connected to the exploitation thereof, the renewable energy sources are of increasingly great importance. Among these sources, the solar energy has a fundamental significance. This is exploited in different manners: that of interest for the purpose of the present invention is the direct trans-formation thereof into electric power by means of photovoltaic panels. These panels, exposed to the solar irradiation, produce a direct current and present a characteristic power-output voltage curve with a maximum of the power for a given value of the voltage at the output terminals of the source. As the functioning conditions of the photovoltaic panel depend to a large extent upon the incident energy, for each value of the irradiation, i.e. of the power per surface unit which the panel receives, a characteristic curve can be determined: all the characteristic curves have a maximum for a given value of the output voltage of the source, but this value varies between a characteristic curve and the other.

As it is apparent, the irradiation conditions of a photovoltaic panel depend upon numerous factors, linked to the seasons, the time and the atmospheric conditions. These latter in particular present an unforeseeable variability, which can also occur very often in the course of the day. The passage of clouds, the formation of damp haze, the change in the humidity content in the air, are all factors which cause more or less rapid and unforeseeable variations in the irradiation. This latter represents, therefore, an uncontrollable quantity that affects the functioning of the source.

It is particularly important to design systems that allow maximizing the power extraction from a photovoltaic panel when the functioning conditions vary and in particular when the uncontrollable quantity represented by the solar irradiation varies.

The photovoltaic panel generates direct current. This can be used, converting it in alternating current by means of an inverter. The output alternating current from the inverter can be put into an electric distribution network and/or can be used to power one or more local loads. Irrespective of the connection of the photovoltaic panel or of the field of photovoltaic panels (directly to the electric distribution network, to single local loads or to a combination of these two operating modes), it is necessary for the inverter to be controlled in such a way as to maintain at the output of the panel or of the field of photovoltaic panels (and therefore at the input of the inverter) a value of the controlled quantity, i.e. of the voltage, that maximizes the power extraction. As the optimal voltage that maximizes the power, which can be extracted from the source varies as mentioned above when the solar irradiation conditions change, control and regulation algorithms have been studied, that allow to modify the operating conditions of the inverter when the irradiation conditions vary, so as to bring the system composed of a source, the inverter and the control loop always towards the condition of maximization of the extracted power.

Examples of algorithms suitable to perform this function are described in WO-A-2007/072517 and in the patent and non-patent documents mentioned herein and in the respective search report, the content of said documents being incorporated in the present description.

Among the most common control algorithms, the algorithm called "Perturb and Observe" should be mentioned. This algorithm provides for perturbing the operating conditions of the source+inverter system, imposing a variation in the output voltage of the source (and thus at the input of the inverter), observing the result of this perturbation, i.e. verifying if the imposed perturbation causes an increase or a decrease in the supplied power. If the supplied power increases, this means that the system is not at the point of maximum power supply, and that the imposed perturbation is in the direction that entails an increase of the supplied power, i.e. a movement towards the maximum supply point. Vice versa, if to the imposed perturbation corresponds a reduction in the supplied power, this means that the imposed perturbation is in the opposite direction to that necessary for maximizing the power that can be extracted.

These algorithms are efficient, but they present some limits, mainly linked to the fact that sudden variations in the radiation conditions cause long times for the system to adapt to the new operating condition, due to the fact that a variation in the irradiation conditions causes a change in the characteristic curvature on which the system must move.

SUMMARY OF THE INVENTION

The object of the invention is to provide a method and a system that entirely or partially reduce the problems of the known systems and methods, allowing in particular to improve the power extraction from renewable energy sources, in particular, although not exclusively, from sources with photovoltaic panels, in which the operating conditions of the source vary depending upon at least one uncontrollable quantity, as indicated above.

According to a first aspect, the invention relates to a method for extracting power from an electric power source by means of a power conditioning circuit, wherein: the operating conditions of said source vary as a function of at least one uncontrollable quantity; for each value of the uncontrollable quantity the source has a characteristic curve of the supplied power as a function of a controlled quantity; each characteristic curve has a maximum for an optimal value of said controlled quantity. Typically, although not exclusively, the source may comprise one or more photovoltaic panels, and in this case the uncontrollable quantity is for example the solar irradiation and the controlled quantity may be the output voltage of the panel or the output current from the panel. According to one embodiment of the present invention, the method according to the present invention provides the steps of:

determining whether the actual value of the controlled quantity is greater or lower than said optimal value for the actual value of said uncontrollable quantity;

generating a regulation signal in order to modify the actual value of the controlled quantity towards said optimal value.

This method substantially differs from the methods based upon the Perturb and Observe algorithms. In fact, in these known algorithms it is provided for perturbing the system causing a variation in the controlled quantity (for example the voltage) and observing if this variation (perturbation) causes an increase or a decrease of the power supplied by the source. In the case in which the perturbation causes an increase in the supplied power, at the subsequent step of the iterative algorithm a new perturbation of the same sign is caused (for example an increase again or a decrease again in the output voltage), and the effect on the supplied power is observed. By repeating this process, after a certain time (unless changes in the uncontrollable quantity) the maximum power point is achieved. It is, therefore, an empirical approach.

Vice versa, the method according to the present invention provides a control algorithm that preliminarily performs a check of the value of the controlled quantity with respect to the optimal value of this quantity. Even if the optimal value (i.e. the value that maximizes the extracted power) is not known a priori, as it depends upon the uncontrollable quantity (or upon more uncontrollable quantities), it is possible, for example by imposing a periodical oscillation of the controlled quantity, to determine whether this quantity has currently a value greater or lower than the optimal value. Based upon this determination, the control loop causes a targeted variation of the controlled quantity towards the optimal value. If the actual value of the controlled quantity is lower than the optimal value, said controlled quantity is increased. If it is greater than the optimal value, the controlled quantity is decreased.

Therefore, contrary to the traditional "Perturb & Observe" methods, to the controlled quantity a variation of random sign is not imposed, to verify subsequently whether the sign of the variation causes an increase or a decrease in the supplied power. On the contrary: the sign of the variation is imposed in such a way as to obtain anyway a displacement of the system towards the optimal value of the controlled quantity for that particular operating condition, i.e. for the current value of the uncontrollable quantity. Consequently, if the uncontrollable quantity (for example, the solar irradiation) varies suddenly, the system will immediately react, imposing, from the first step of the control algorithm, a variation in the controlled quantity towards the new optimal value.

Below reference will be made specifically to the use of the new method for systems that use photovoltaic panels, but it must be understood that this method can be advantageously applied also in other situations, where it is necessary to extract power from a source with limited power, which presents a characteristic curve variable as a function of an uncontrollable parameter or quantity and in which the characteristic curves (or at least some of them) have at least a maximum of power that can be supplied for an optimal value of the controlled quantity. In some embodiments, the source can be a fuel cell, or a set or fuel cells, wherein the uncontrollable quantity can be represented for example by the flow rate of hydrogen or other fuel gas, or by the ageing of the cell.

In general, uncontrollable quantity can be intended as a generic quantity constituted by the sum of more factors or parameters. Typically, for example in the case of a photovoltaic panel, the factors which can affect the characteristic functioning curve comprise not only the irradiation, but also the working temperature of the panel, the alterations to which the panel is subjected over the time, etc.

In some embodiments, the method provides that to the value of the controlled quantity a positive variation is imposed if the actual value of the controlled quantity is lower than said optimal value, and a variation of negative sign if the actual value of the controlled quantity is greater than said optimal value.

In order to verify whether the actual value of the controlled quantity is greater or lower than the optimal value, according to some embodiments of the present invention it is provided for the regulation signal to contain a disturbance with at least one periodic component. Advantageously, by means of said disturbance a periodic variation is caused in the controlled quantity and, consequently, in the power supplied by said source. The variation in the power and in the controlled quantity are correlated so as to determine whether the value of the controlled quantity is greater or lower than said optimal value.

In principle, the disturbance of the controlled quantity can be the ripple on the input voltage of an inverter, whose input is connected to the source and whose output is connected to a distribution network. However, the control loop preferably comprises a block which adds to the regulation signal of the controlled quantity a disturbance constituted by or including a, sinusoidal or non sinusoidal periodic signal.

Further advantageous embodiments and features of the method according to the present invention are indicated in the appended dependant claims and will be described in greater detail hereunder with reference to an embodiment.

According to a different aspect, the invention relates to a system for generating electric power, comprising:

a DC voltage electric power source, whose operating conditions vary as a function of at least one uncontrollable quantity, for each value of the uncontrollable quantity the source having a characteristic curve of the supplied power as a function of a controlled quantity, each characteristic curve presenting a maximum for an optimal value of said controlled quantity;

a power conditioning circuit, for extracting a DC-voltage power from said source and supplying power at an output;

a regulation loop to adjust said controlled quantity maximizing the power supplied by said source when said uncontrollable quantity varies;

wherein the regulation loop is designed so as to determine whether, for the actual value of said uncontrollable quantity, the actual value of the controlled quantity is greater or lower than said optimal value and to generate a regulation signal to modify the actual value of the controlled quantity towards said optimal value.

The power conditioning circuit can include a DC/AC inverter, connected for example to an electric power distribution network and/or to one or more local loads. In other embodiments the power conditioning circuit can be constituted by or can include a DC/DC converter.

Further advantageous embodiments and features of the plant according to the invention are described hereunder with reference to a practical embodiment of the invention.

BRIEF DESCRIPTION OF THE DRAWINGS

The invention will be better understood by following the description below and the attached drawing, which shows a non-limiting practical embodiment of the invention. More in particular, in the drawing:

FIGS. 5A, 5B, and 5C show diagrams representing waveforms of the signals in the different points of the control loop of the system schematically shown in FIG. 3 or in FIG. 4.

DETAILED DESCRIPTION OF EMBODIMENTS OF THE INVENTION

Below the invention will be described with specific reference to its application to photovoltaic panels, but it must be understood that the method and the system according to the invention can be realized also by using other renewable energy sources, when similar behaviors of the source occur, i.e. when the source has a characteristic curve of the power as a function of a controlled quantity, and this characteristic curve varies when an uncontrollable quantity varies.

For a better understanding of the functioning principle of the present invention and the advantages which can be achieved thereby with respect to the traditional methods, it is necessary firstly to remind some elements related to the behavior of the renewable sources, in particular the photovoltaic panels, depending upon their functioning conditions.

Figure 1:
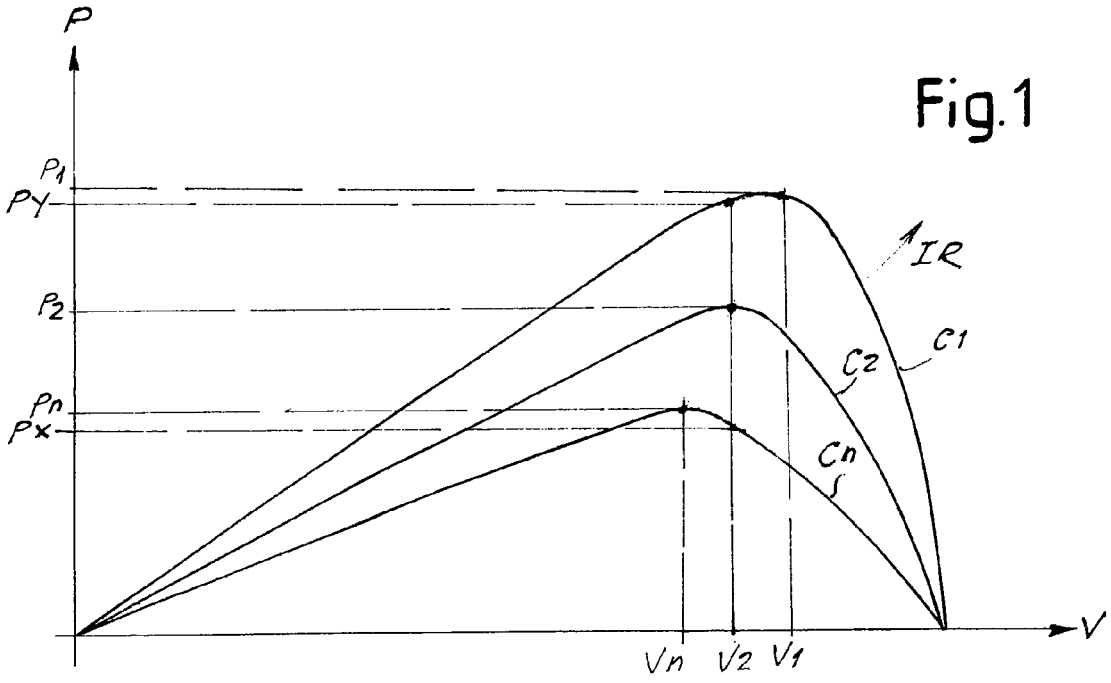
FIG. 1 shows a family of characteristic curves of a renewable energy source, typically a photovoltaic panel, for different irradiation conditions.

As mentioned above, the photovoltaic panel supplies a power that is a function of the voltage at the output connector terminals of the panel. The power characteristic curve as a function of the output voltage is not invariant, but it modifies when the irradiation varies, i.e. when the power per surface unit which reaches the panel varies. FIG. 1 shows a series of characteristic curves indicated with C1, C2, . . . Cn, each of which corresponds to a different irradiation condition of a photovoltaic panel. Each characteristic curve C1-Cn represents the variation of the power P (indicated on the ordinates) that can be extracted by the panel as a function of the voltage V (indicated on the abscissas) at the output of the panel. Each characteristic curve C1-Cn has a maximum, in correspondence to a value of the voltage. The voltage values, indicated with V1, V2, and V3, corresponding to the maximum of the power extractable from the photovoltaic panel, vary when the irradiation conditions vary. More in particular, the greater is the irradiation, the greater is the voltage for which the panel supplies the maximum of the power. In FIG. 1 the irradiation increases according to the arrow IR, therefore the curve C1 is that corresponding to the maximum value of the irradiation and the curve Cn is that corresponding to the minimum value of irradiation. The voltage V1 is greater than the voltage Vn.

Figure 2:
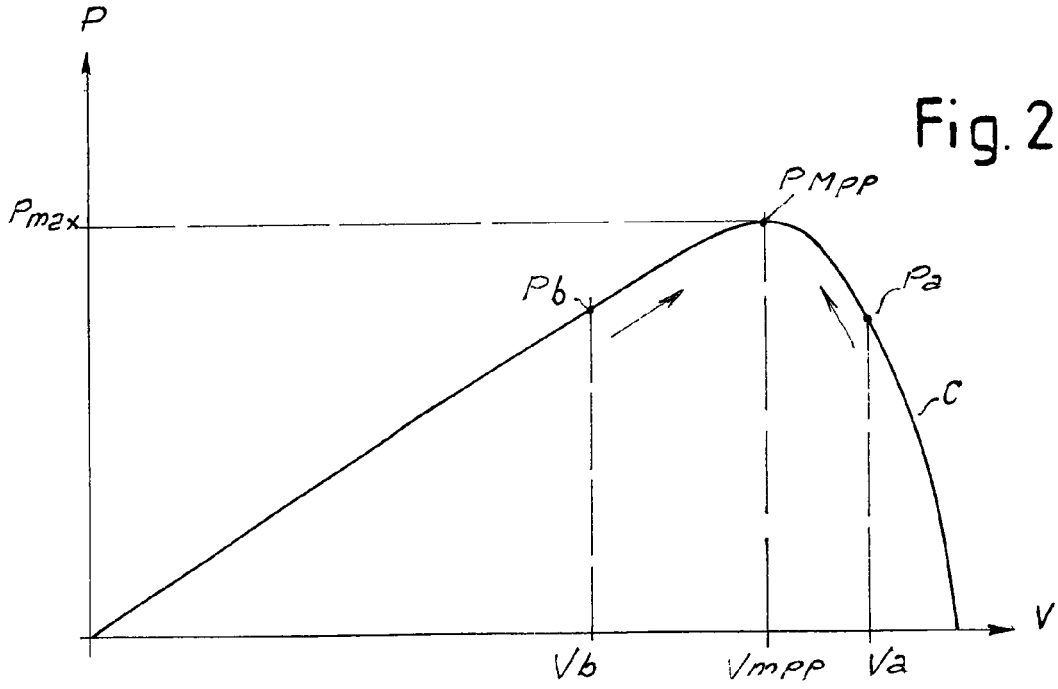
FIG. 2 shows a single characteristic curve of the source.

FIG. 2 shows, for the sake of greater clarity of representation, a single characteristic curve labeled C. Va and Vb indicate two values of the output voltage of the photovoltaic panel in correspondence to which the supplied power is lower than the maximum extractable power Pmax for that given solar irradiation value. Vmpp indicates the voltage that maximizes the extractable power (mpp=maximum power point). Therefore, the system in which the photovoltaic panel is inserted will be able to supply the maximum of the power in this irradiation condition if at the ends of the photovoltaic panel a voltage Vmpp is maintained. Vice versa, if the voltage is equal to Va, in order to maximize the extracted power it will be necessary to decrease the voltage at the output of the photovoltaic panel to shift from the point Pa, on the right of the curve C, to the point Pmpp. On the contrary, being at the point Pb, with an output voltage Vb at the photovoltaic panel, in order to maximize the power in this irradiation condition it will be necessary to increase gradually the voltage at the output of the panel, until the value Vmpp is achieved again.

Would the irradiation maintain constant, the control of the inverter connected to the output of the photovoltaic panel would be relatively simple. Vice versa, the irradiation can vary also in a sudden manner and repeatedly over time, as mentioned above. This entails particular difficulties.

With reference to FIG. 1 again, it can be assumed for example that the system is on the curve C2 and that, thanks to the adjustment imposed by a "perturb and observe" algorithm of the traditional type, a condition of maximum efficiency has been achieved, i.e. at the terminals of the photovoltaic panel an output voltage V2 has been achieved, corresponding to a supplied power P2. If at this point the irradiation conditions change suddenly, for example if a decrease in the irradiation occurs due to the passage of a cloud, the system passes from the curve C2 to the curve Cn and the supplied power will decrease suddenly to the value Px, lower than the value Pn corresponding to the maximum of the characteristic curve Cn. In order to put the system again to the optimal operating conditions, the control algorithm must cause a gradual decrease in the voltage from the value V2 to the value Vn. Vice versa, if from the irradiation conditions corresponding to the curve C2 the solar irradiation suddenly increases bringing the system to operate on the curve C1, the supplied power will pass from the value P2 to the value Py which is lower than the maximum power value P1 which can be extracted from the photovoltaic panel under these irradiation conditions. Therefore, the control algorithm must make the system to pass gradually from the voltage V2 to the voltage V1, i.e. increasing the output voltage, a variation in the opposite direction with respect to that which would be imposed to the system in the case of a decrease in the irradiation and a passage to the conditions of the curve C2 to the conditions of the curve C1.

The normal control systems of the photovoltaic systems are not able to follow these sudden changes in the irradiation in an adequately fast manner, as they are not able to determine whether a given variation of the irradiation conditions leads the system to operate with a greater or lower voltage with respect to the voltage that maximizes the power that can be extracted under a previous irradiation condition.

In other words, the traditional systems are not able to detect whether, varying the irradiation condition, it is necessary to increase or to decrease the voltage to bring the system again to the conditions of extractable-power maximization. The traditional systems require a significant time to adapt to the new solar irradiation conditions.

This problem is solved through a control method as described below and illustrated in particular in FIGS. 3, 4, and 5.

Briefly, the method according to the present invention provides for the control loop to be able to detect the position in which the system is operating with respect to the optimal value of the output voltage from the photovoltaic panel, and it is therefore suitable to "decide" whether the output voltage from the photovoltaic panel must be increased or decreased to achieve the conditions of extracted power maximization. Consequently, when the irradiation conditions vary, the system can start immediately to move varying the operating conditions of the inverter connected to the photovoltaic panel, causing by means of a regulation signal the correct variation (increase or decrease as the case may be) of the voltage input at the inverter, and therefore the voltage output at the photovoltaic panel, to bring the system towards the new condition of extractable power maximization.

Figure 3:
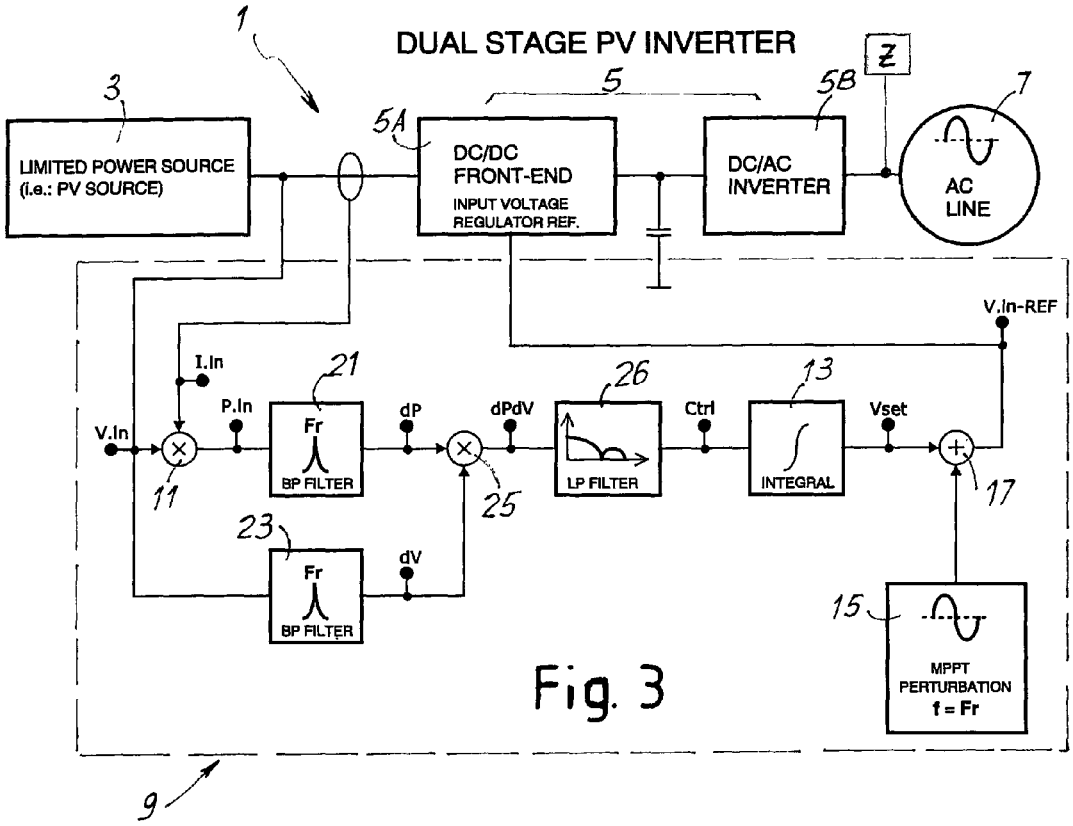
FIG. 3 shows a block diagram of a system that embodies the present invention.

For a better understanding of the functioning of the method and of the system according to the invention, reference should first be made to the block diagram of FIG. 3. In this diagram the system is indicated as a whole with the number 1. It comprises a renewable energy source, for example a photovoltaic panel or a field of photovoltaic panels, indicated as a whole with the number 3. The source 3 supplies electric power in DC voltage and its output is connected to a double—stage inverter indicated as a whole with the number 5. Number 5A indicates a first DC/DC stage (front-end), and number 5B indicates a second DC/AC stage. The output of the inverter 5 is connected with one or more local loads and/or with the electric power grid. In the diagram of FIG. 3, the output of the inverter 5 is connected to a generic load Z and to the power grid schematically indicated with the number 7. A connection of this type allows to input into the electric power grid 7 the power which is not adsorbed by the local load Z, to power the local load Z with the energy generated by the renewable source 3, or (when the source 3 is not able to supply sufficient power) to power the load Z by absorbing electric energy from the power grid 7.

The system constituted by the source 3 and by the inverter 5 is controlled by means of a regulation or control loop schematically indicated with the number 9. This regulation loop 9, whose functions and manner of control will be described hereunder, can be realized both via software or via hardware, or through mixed solutions. Those skilled in the art will be able, on the base of the description below, to design a plurality of possible configurations which embody the control loop that carries out the method according to the present invention.

The control loop is connected to the output of the source 3 in order to detect a signal V.in proportional to the output voltage of the source and furthermore to detect a value I.in proportional to the current supplied by the source towards the inverter 5.

From the current value I.in and the voltage value V.in, by means of a simple multiplication in the multiplier block 11, a signal is obtained, proportional to the power supplied by the source 3 towards the inverter 5 (P.in=V.in*I.in).

From the power signal and the voltage signal, through adequate processing, at the output from a regulator 13 a voltage set point, indicated with Vset is generated. This regulation signal is used to control the inverter 5 and more precisely the first stage 5A of the inverter, so as to bring the system towards the point of optimal functioning, i.e. in such a way as to bring the output voltage from the source 3 to the value that, under the particular irradiation condition, maximizes the power extractable from the source.

In order to determine whether the output voltage V.in from the source 3 is greater or lower than the optimal voltage value, i.e. the value that maximizes the power which can be supplied under a given irradiation condition, to the value Vset, representing the voltage set point fixed by the regulator 13, a periodic disturbance is added at an adequate frequency, for example variable between 0.1 and 100 Hz, values that must be considered as non limiting examples. Theoretically, this disturbance can be constituted by the oscillation imposed at input to the inverter 5 by the oscillation of the network voltage to which the output of the inverter is connected. In a preferred embodiment, however, this disturbance is generated by a block 15.

In some embodiments, the disturbance is constituted by a sinusoidal signal. However, this is not strictly necessary. It can have, for instance, a triangular or rectangular waveform, or also a more complex form. In general, the disturbance contains at least one periodic component, for example a sinusoidal component with a given frequency f=Fr, which can be fixed or variable. Also the amplitude of the disturbance can be constant or variable. The disturbance generated by the block 15 is added in the adder 17 to the voltage set point Vset, i.e. to the regulation signal generated by the regulator 13. In this way a voltage reference, or regulation signal, V.in-REF is generated given by the combination of the voltage set point Vset and by the disturbance signal containing the periodic component. This periodic component, overlapped to the reference voltage value generated by the regulator 13, causes a consequent and corresponding periodic variation of the input voltage at the front-end 5A of the inverter 5, voltage that corresponds to the output voltage of the source 3. This periodic voltage variation that is induced by the disturbance combined with the voltage set point Vset given by the regulator 13 causes, due to the characteristic curve of the source 3, a corresponding variation in the supplied power, variation that is cyclic with the same frequency of the disturbance applied to the signal Vset.

Figure 4:
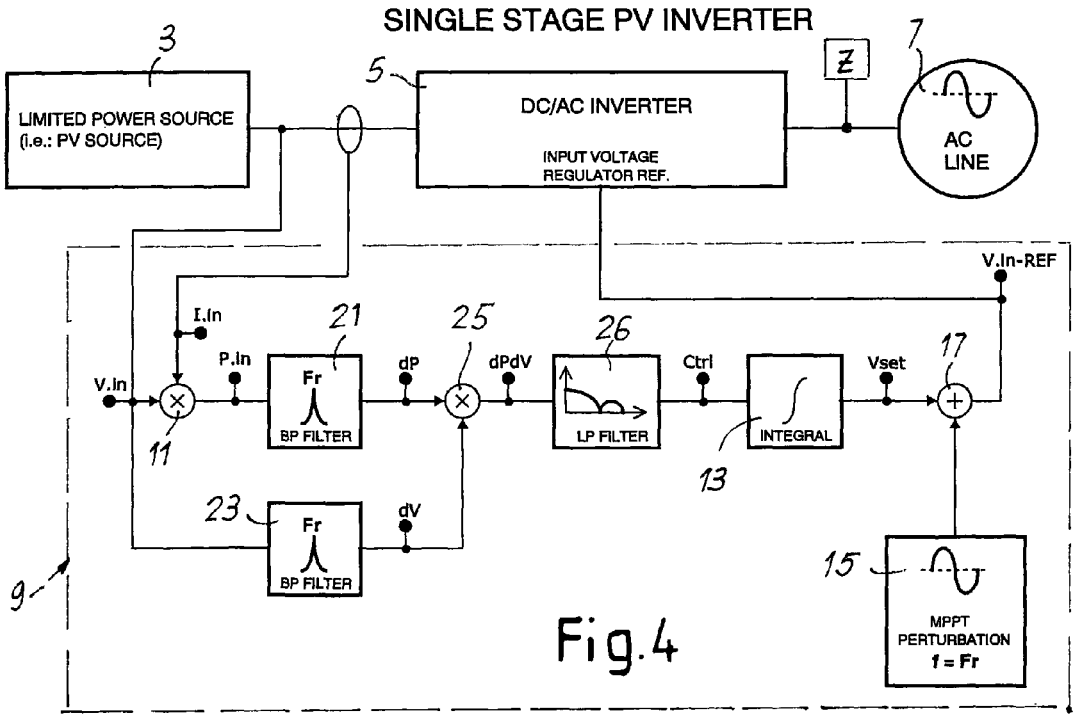
FIG. 4 shows a block diagram similar to that of FIG. 3 in a modified embodiment.

The diagram in FIG. 4 is substantially equivalent to that of FIG. 3 and the same reference numbers indicate the same or equivalent parts in the two figures. The difference between the diagram of FIG. 4 and the diagram of FIG. 3 consists substantially of the fact that the inverter is a one-stage inverter instead of a double-stage inverter. In both diagrams, elements have been omitted, that are not necessary for understanding the present invention and in anyway that are known to those skilled in the art.

With reference to FIG. 2, it is understood that if the instantaneous output voltage is equal to Va, i.e. it is greater than the voltage Vmpp that maximizes the power extractable from the source, the oscillation of the voltage causes a corresponding oscillation of opposite sign in the output power. The contrary situation occurs when the functioning point is in correspondence to the voltage value Vb lower than the value Vmpp. In this case, a periodic variation in the output voltage from the source causes an analogous variation of the power with the same phase.

It is therefore understood that, by calculating the correlation between the curve representing the power and the curve representing the output voltage from the source, it is possible to determine whether the average output voltage from the source is lower or greater than the voltage Vmpp that maximizes the extractable power for the given irradiation condition.

To calculate the correlation between the voltage variation and the power variation caused by the disturbance containing the periodic component added to the voltage set point to obtain the signal V.in-REF, the control loop 9 comprises a block 21 that filters the power signal obtained by the multiplier 11 and a block 23 that filters the voltage signal V.in. The blocks 21 and 23 can be realized for example through corresponding band-pass filters, or through another adequate type of filter. In general, the filters realized in the blocks 21 and 23 will be centered on the frequency Fr of the variable periodic component of the disturbance generated by the block 15, so that at the output of the blocks 21 and 23 there will be two signals dP and dV, containing only the variable component with frequency Fr of the signal, as the fixed components and any component with a frequency different from the fundamental frequency Fr of the disturbance signal have been removed.

In the multiplier block 25 the signals dP and dV are multiplied one by the other, in order to obtain the correlation dPdV between power variation and voltage variation. The correlation signal dPdV is filtered through a block 26, for example a band-pass filter, which cuts the frequency of the periodic component of the disturbance generated by the block 15 and/or the base frequency and the harmonics thereof when it is a non-sinusoidal signal. In this way, at the output of the filter block 26 a nearly continuous signal Ctrl is obtained, whose value and sign are determined by the average value of the correlation dPdV. This substantially continuous signal is applied to the regulator 13. This latter is preferably a PI (proportional and integral) regulator or simply an integral regulator, and generates the voltage set point Vset starting from the obtained signal Ctrl described above. In other embodiments, the filter block 26 can be omitted and its function can be performed directly by the regulator. However, in this case the dynamics of the system is reduced. The use of a band-pass filter upstream of the regulator allows making the speed of the regulation system independent from the filter function, thus avoiding penalizing the dynamic response of the regulation system.

Figure 5B:
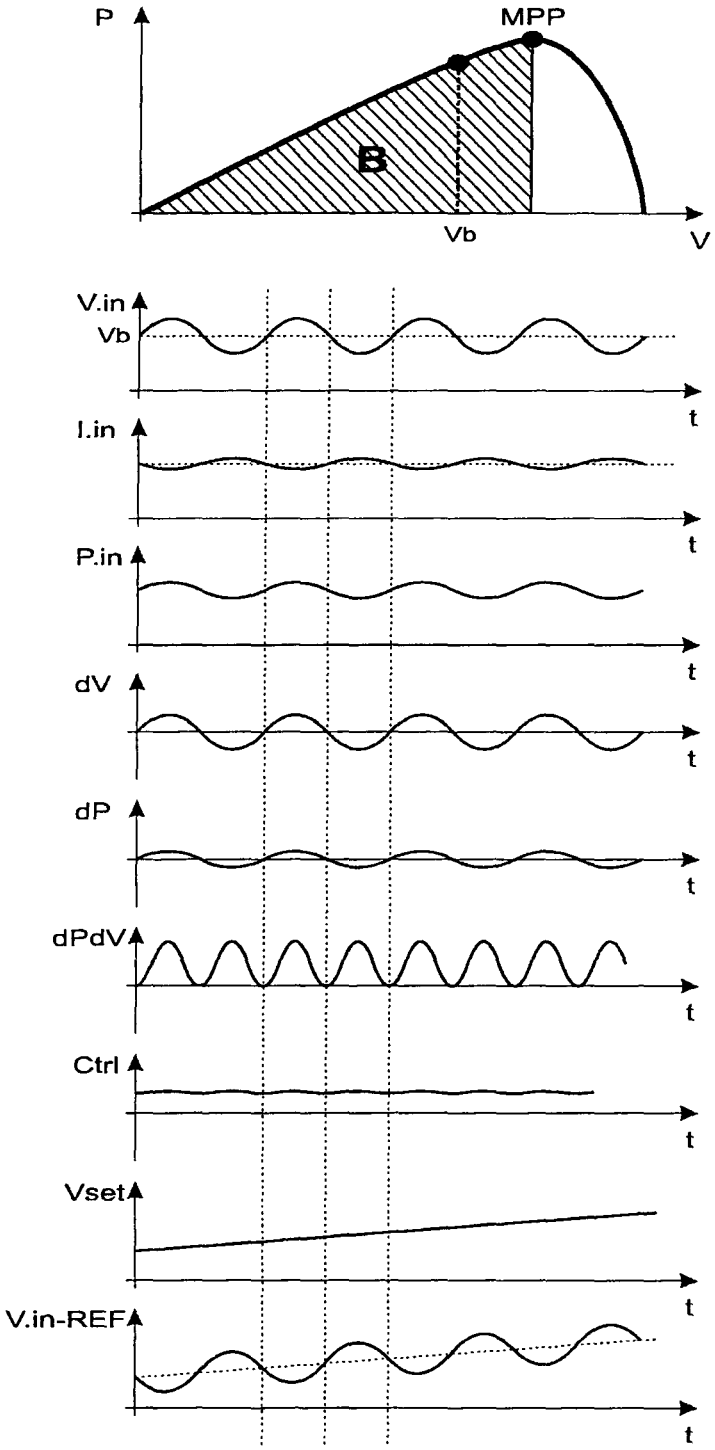
Figure 5C:
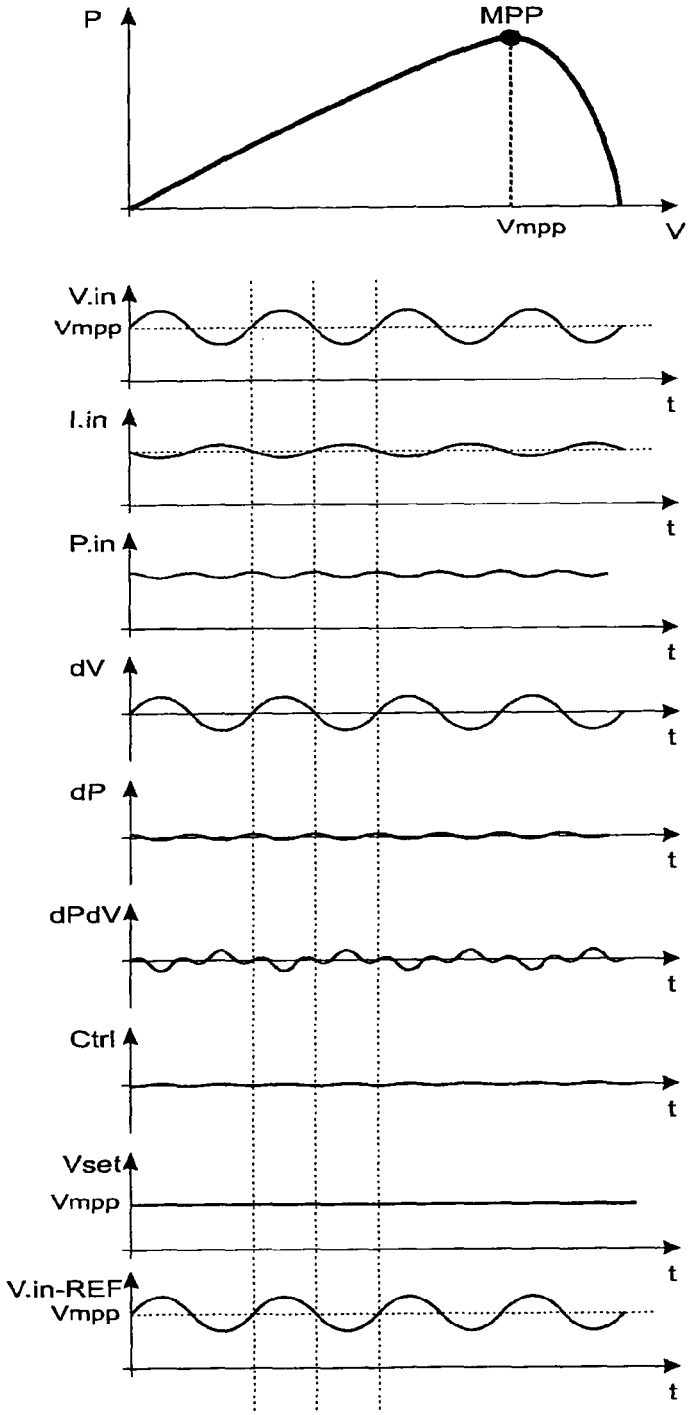

The waveforms represented in FIGS. 5A, 5B and 5C better explain the operation of the above-described system. In these diagrams the open loop waveforms are indicated for a simpler description of the functioning principle of the regulation system.

With reference for example to FIG. 5A, it should be noted that the output voltage V.in of the source 3 has an average value Va and oscillates with a frequency Fr around this value, oscillation imposed by the disturbance generated by the block 15 and added to the voltage set point Vset generated by the regulator 13. This voltage variation around the value Va causes a corresponding periodic oscillation with equal frequency Fr of the power P.in. It can be observed that, as represented by the first diagram at the top of FIG. 5A, it has been assumed that the output voltage value Va of the source 3 is greater than the value that maximizes the power extractable from the source.

As in this assumption the voltage Va is greater than the voltage corresponding to the maximum power that can be supplied, the output power oscillation P.in supplied by the source oscillates with the same frequency of the output voltage V.in, but in phase opposition: when the voltage V.in has its maximum, the power P.in has its minimum, and vice versa. The output current I.in from the source 3 has a pattern corresponding to that of the power.

In the fourth and fifth diagram of FIG. 5A the values dV and dP are represented, obtained by filtering the signal V.in and the signal P.in, the first obtained by a direct measurement of the output voltage from the source and the second obtained by multiplying the output voltage by the output current. As it can be observed in the diagrams of FIG. 5A, the signals dV and dP oscillate with the same frequency of the voltage V.in, and therefore with the same frequency Fr of the disturbance generated by the block 15, nearly zero.

By multiplying the signals dV and dP the correlation is obtained between said signals, which is represented in the fourth diagram from the top of FIG. 5A, indicated with dPdV. This correlation has an average negative value with a double frequency with respect to the frequency Fr of the periodic component of the disturbance applied to the voltage set point Vset.

By filtering in the block 26 the correlation signal dVdP the substantially continuous signal Ctrl is obtained, represented in the seventh diagram of FIG. 5A. This signal is negative, as it is obtained by filtering the correlation signal that, as described above, has a negative value. By applying the signal Ctrl to the regulator integrator 13, a voltage set point Vset is obtained, with a gradually linearly decreasing trend. This corresponds to the fact that, in order to obtain the maximization of the power extractable from the source under these conditions, the voltage Va must be effectively reduced with respect to the actual value.

As initially indicated, to the regulation signal Vset the disturbance signal with the periodic component is added, to obtain the signal V.in-REF, as represented in the last diagram of FIG. 5A. This periodic oscillation overlapped to the voltage set point Vset causes in turn the periodic oscillation of the output voltage V.in from the source.

FIG. 5B shows a situation in which the system is working with an output voltage Vb from the source 3 that is lower than the voltage that maximizes the extractable power. The waveforms of the diagrams below the characteristic curve represent the same signals described above, i.e. in the order from the top to the bottom: the output voltage from the source with overlapped periodic oscillation induced by the disturbance injected on the signal of voltage set point Vset, the output current from the source, the output power from the source, the voltage variation over the time, the power variation over the time, the correlation between power time variation and voltage time variation, the output control signal from the filter 26, the output voltage set point Vset from the regulator 13 and the regulation signal V.in-REF obtained through the combination of the voltage set point Vset with the disturbance containing the periodic component.

As in this case the average output voltage Vb of the source is lower than the value that maximizes the power, periodic variations in the output voltage cause corresponding periodic variations in the power, in phase with the voltage variations. Consequently, the correlation dPdV between voltage variation and power variation has a periodic waveform again with double frequency with respect to the frequency of the disturbance injected on the regulation signal, but this correlation has a positive average value. The signal Ctrl obtained by filtering the correlation signal is therefore substantially continuous, but with positive sign and consequently the output voltage set point from the regulator 13 has a linearly increasing trend. This corresponds the fact that, in order to bring the systems in optimal conditions of maximum extracted power, the output voltage from the source, which is the parameter controlled by the system, must be gradually increased from the value Vb to the maximum power value (Vmpp).

It is understood that in this way the system can be brought in an extremely fast manner towards the optimal functioning point, i.e. to the voltage which maximizes the extracted power, as the voltage set point Vset has the correct value to modify the voltage in the direction necessary for the maximization of the power even when the system has been brought on a different characteristic curve by a sudden variation in the irradiation.

Once the maximum extractable power point has been achieved, the system will have the behavior illustrated in FIG. 5C, where the output voltage from the source 3 is equal to the value Vmpp and therefore the extracted power is maximum. Under the characteristic curve the waveforms are shown, representing the signals described above with reference to FIGS. 5A and 5B, in the particular case of voltage corresponding to the optimal value. It can be observed in this case that the oscillation imposed to the output voltage from the source by the disturbance signal causes an oscillation around the maximum point, and consequently the extracted power will be subjected to an oscillation with a frequency double with respect to that of the disturbance. In a corresponding manner, the correlation dPdV will have an average value equal to zero. The signal Ctrl obtained by filtering the correlation dPdV has a substantially continuous and equal to zero value, and consequently the voltage set point Vset will remain constant and fixed at the value Vmpp.

It is understood that the drawing only shows an example provided by way of a practical arrangement of the invention, which can vary in forms and arrangements without however departing from the scope of the concept underlying the invention. Any reference numbers in the appended claims are provided for the sole purpose of facilitating reading of the claims in the light of the description and the drawing, and do not in any manner limit the scope of protection represented by the claims.

The invention claimed is:

1. A method for extracting power from an electric power source, wherein the power source has operating conditions that vary as a function of at least one uncontrollable quantity, wherein for each value of the uncontrollable quantity the power source presents a characteristic curve of the supplied power as a function of a value of a controlled quantity, and wherein each characteristic curve has a maximum for an optimal value the controlled quantity, the method comprising:

generating a regulation signal;

causing a periodic variation of the controlled quantity around an actual value of the controlled quantity and consequently a periodic variation in the power supplied by the power source by introducing in the regulation signal a disturbance having at least one periodic component;

calculating a correlation between the periodic power variation and the periodic variation of the controlled quantity, the correlation providing a positive or negative correlation sign indicating whether the actual value of the controlled quantity is greater than or lower than the optimal value; and using the correlation sign to adjust the regulation signal such that the value of the controlled quantity is automatically increased if the actual value of the controlled quantity is lower than the optimal value or decreased if the actual value of the controlled quantity is greater than the optimal value.

2. The method of claim 1, said controlled quantity comprising the output voltage of said power source.

3. The method of claim 1, said controlled quantity comprising the current supplied by said power source.

4. The method of claim 1, said power source comprising a renewable energy source.

5. The method of claim 4, said renewable energy source comprising one or more photovoltaic panels, said at least one uncontrollable quantity comprising solar irradiation.

6. The method of claim 1, said power source comprising one or more fuel cells.

7. A method of extracting power from an electric power source, the method comprising:

providing a power source having operating conditions that vary as a function of values of one or more uncontrollable quantities;

identifying a characteristic curve for each value of the one or more uncontrollable quantities as a function of a controlled quantity, each characteristic curve further having a maximum as an optimal value of said controlled quantity;

determining whether an actual value of the controlled quantity is greater or lower than said optimal value for the actual value of said uncontrollable quantity;

generating a regulation signal of the controlled quantity;

introducing in said regulation signal a disturbance comprising one or more periodic components;

causing a periodic variation of the controlled quantity and consequently a variation of the power extracted from the source based on the effect of said periodic component;

determining a correlation between the variation of the power extracted from the source and the variation of the controlled quantity, the correlation providing a positive or negative correlation sign, said correlation sign representing whether the actual value of the controlled quantity is greater than or lower than said optimal value; and using the correlation sign to adjust the regulation signal such that the value of the controlled quantity is automatically increased if the actual value of the controlled quantity is lower than said optimal value or decreased if the actual value of the controlled quantity is greater than said optimal value.

8. The method of claim 7, further comprising the steps of:

detecting a time variation of the power supplied by said source;

detecting a time variation of an output voltage of said source;

calculating the correlation by calculating the correlation between the power variation of said source and the output voltage variation of said source; and controlling a power conditioning circuit associated with the power source based on the regulation signal containing said disturbance causing a periodic variation of the input voltage of the conditioning circuit and therefore of the output voltage from said power source, which in turn causes a periodic variation of the power supplied by the source.

9. The method of claim 8, wherein said time variation of the power supplied by the source is filtered with a band-pass filter centered on the frequency of said disturbance, and wherein said time variation of the controlled quantity is filtered with a band-pass filter centered on the frequency of said disturbance.

10. The method of claim 9, wherein said correlation is filtered with a band-pass filter and is applied at the input of an integral regulator or proportional-integral regulator, in order to obtain said regulation signal.

11. The method of claim 10, said periodic component of the disturbance comprising a fixed frequency.

12. The method of claim 10, said periodic component of the disturbance comprising a variable frequency.

13. An electric power generation system, comprising:

a DC-voltage electric power source having operating conditions that vary as a function of one or more uncontrollable quantities, each uncontrollable quantity having characteristic curves for a plurality of values of the supplied power as a function of a controlled quantity, each characteristic curve further comprising a maximum as an optimal value of said controlled quantity;

a power conditioning circuit effective to extract power from said DC-voltage source to supply power at an output; and a regulation loop configured to cause a periodic variation of the controlled quantity at the output of the source and consequently a periodic variation of the power supplied by said source;

calculate a correlation between the periodic variation of the power and the periodic variation of said controlled quantity at the output of the source, the sign of said correlation indicating whether the actual value of the controlled quantity is greater or lower than said optimal value for the actual value of said uncontrollable quantity; and generate a regulation signal to modify the actual value of the controlled quantity towards said optimal value, as a function of said correlation and said correlation sign.

14. The system of claim 13, wherein the regulation loop is further configured to cause the periodic variation in the controlled quantity by introducing a periodic disturbance in the regulation signal.

15. The system of claim 14, wherein the regulation loop further comprises:

a voltage input coupled to an output of said power source;

a current input supplied by said power source;

a first regulation block configured to calculate the power supplied by said source;

a second block configured to determine the correlation between the output voltage regulation and the variation of the power supplied by said source and upon which the regulation signal is based;

a third block configured to generate the disturbance containing one or more periodic components as introduced in said regulation signal.

16. The system of claim 15, said regulator comprising an integral regulator or a proportional-integral regulator.

* * * * *